US005241730A

United States Patent [19]

Simmen et al.

[11] Patent Number: 5,241,730

[45] Date of Patent: Sep. 7, 1993

[54] DEVICE FOR JET-BULKING OF AT LEAST ONE MULTIFILAMENT YARN

[75] Inventors: Christian Simmen, Schonengrund; Kurt Klesel, Wolfhalden, both of Switzerland

[73] Assignee: Heberlein Maschinenfabrik AG, Wattwil, Switzerland

[21] Appl. No.: 776,166

[22] Filed: Oct. 15, 1991

[30] Foreign Application Priority Data

Nov. 6, 1990 [CH] Switzerland ..... 3527/90

[51] Int. Cl.[5] ..... D02G 1/16; D02G 1/12

[52] U.S. Cl. ..... 28/273; 28/254

[58] Field of Search ..... 28/271, 273, 254, 272, 28/274

[56] References Cited

U.S. PATENT DOCUMENTS

| | | | |
|---|---|---|---|
| 2,924,000 | 2/1960 | Griset, Jr. et al. | 28/254 |
| 4,104,770 | 8/1978 | Massey, Jr. et al. . | |
| 4,187,593 | 2/1980 | Price | 28/273 X |
| 4,259,768 | 4/1981 | Clendening, Jr. | 28/273 X |
| 4,282,637 | 8/1981 | Mosseri et al. | 28/273 X |
| 4,290,177 | 9/1981 | Price et al. | 28/273 X |
| 4,547,938 | 10/1985 | Cullen et al. | 28/273 X |
| 4,922,593 | 5/1990 | Gorrafa | 28/273 X |
| 5,020,199 | 6/1991 | Gorrafa | 28/273 |

FOREIGN PATENT DOCUMENTS 1592665 7/1981 United Kingdom .

*Primary Examiner*—Clifford D. Crowder
*Assistant Examiner*—Bibhu Mohanty
*Attorney, Agent, or Firm*—Young & Thompson

[57] ABSTRACT

The device has a guide body (1) with a through bore, which exhibits an outlet opening (3). A needle body contains a through yarn channel, which is coaxially aligned with the bore of guide body (1). One end of the needle body extends into a conical inlet section of the guide body bore and forms, with it, a passage gap for the blowing air. The blowing air is introduced by two feed bores (11, 12) into the annular space in front of the passage gap. An impact body (9) is placed in the area of outlet opening (3). A yarn (FT), coming from outlet opening (3), is deflected in front of impact body (9) from a median plane (M), which contains the axis of the guide body bore point (A) described by the intersection of a median plane (M), a plane (E) parallel to the axis of the guide body bore and perpendicular to plane (M) and located in such a way that the cross sectional areas of the medium feed bores on opposite sides of said plane (E) are equal, and a plane perpendicular to said axis and including the mouths by which the medium feed bores (11, 12) empty into an annular space in the conical inlet section (7). As a result the textured yarn becomes more compact and has only small uniformly distributed projecting loops.

10 Claims, 2 Drawing Sheets

DEVICE FOR JET-BULKING OF AT LEAST ONE MULTIFILAMENT YARN

FIELD OF THE INVENTION

The invention relates to a device for jet-bulking of at least one multifilament yarn, with a guide body, which exhibits a through bore with a conical inlet section and outlet section, with a needle body, which contains a through yarn channel approximately coaxially aligned with the bore of the guide body, extends with one end into said conical inlet section and exhibits a peripheral surface, which, with the wall of the conical inlet section, forms a passage gap for a blowing medium, which can be introduced into the annular space surrounding the needle body in front of the passage gap and with an impact body placed on the outlet side of the bore of the guide body.

BACKGROUND OF THE INVENTION

In the processing and use of multifilament yarns textured with such devices, the mutual cohesion of filaments plays a substantial role. Yarns with good internal cohesion are not only easier to process but they also have a higher wear resistance in use. Thus a high serviceability of the yarns results, e.g, as sewing yarns or the textile fabrics produced with the yarns. The internal cohesion of the textured multifilament yarns is often also designated as the entanglement level.

Additionally, the textured multifilament yarns have the property that filaments project from a yarn core part and are formed in loops. The shape and distribution of the loops projecting from the yarn core part are important for the appearance and textile feel of the fabrics. Although the shape and distribution of the loops are greatly determined by the type of the fed yarns and the settings (pressure of the blowing medium and yarn feed and removal rate in or out of the texturing device), the jet-bulking device also makes a substantial contribution. A good texturing device should have the ability to distribute the loops uniformly and to lay them closely on the yarn core part.

The distribution of the filaments in the yarn bundle is also important, for example, it is responsible for the uniformity of the color component distribution in yarns, which are produced from feed yarns with filaments of different colors or with differently dyed filaments. Such yarns are typically used for the production of seat covers. Bunching individual color components greatly spoils the effect in the finished product.

It is expected of an effectively working jet-bulking device that it produce a uniform, compact texture even at a high yarn excess delivery. The yarn excess delivery is defined as the ratio of yarn feed rate into the texturing device to the removal rate, and is calculated separately for each yarn strand fed to the nozzle. Typically, for highly excess-delivered yarns at least two multifilament yarns or strands are fed, namely a core yarn or stayer yarn with an excess delivery of 1.03 to 1.2 and at least one effect yarn strand with an excess delivery of 1.2 to 4.

SUMMARY OF THE INVENTION

The object of the invention consists in configuring the initially indicated jet-bulking device so that the textured yarn coming from the device has a greater tension than in known jet-bulking devices, by which the entanglement level of the yarn is greater and that at the same time a more even intimate mixing of the filaments in the yarn and a more uniformly distributed loop structure with loops bound more closely on the yarn core are achieved.

In the known jet-bulking devices, which form the starting point here, a feed bore for the blowing medium empties into the annular space surrounding the needle body in front of the passage gap at a distance from the axis of the guide body bore. The yarn leaving the outlet opening of the guide body is deflected on a cylindrical impact body surface, whose axis is perpendicular to a median plane, which goes through the axis of the guide body bore and through the axis of the blowing medium feed bore. Thus the running yarn remains in this median plane.

On the other hand, the device according to the invention, with which the indicated object is achieved, is characterized in that a yarn, leaving the outlet opening of the guide body is deflected from a median plane, which contains the axis of the guide body bore and the point (A) defined by the intersection of said median plane (M) and a plane (E) parallel to the axis of the guide body and perpendicular to the median plane, located in such a manner that the cross sectional areas of the medium feed bores on opposite sides of said plane (E) are equal, and a plane perpendicular to said axis and including the mouths by which said medium feed bores empty into an annular space in the conical inlet section, point (A) is at a distance from the axis of the guide body bore.

In preferred embodiments the needle body contains two blowing medium feed bores emptying into said annular space, which are placed symmetrically to one another relative to the median plane.

BRIEF DESCRIPTION OF THE DRAWINGS

Embodiments of the invention are explained below in greater detail by the drawings.

DETAILED DESCRIPTION OF THE INVENTION

Figure 1:
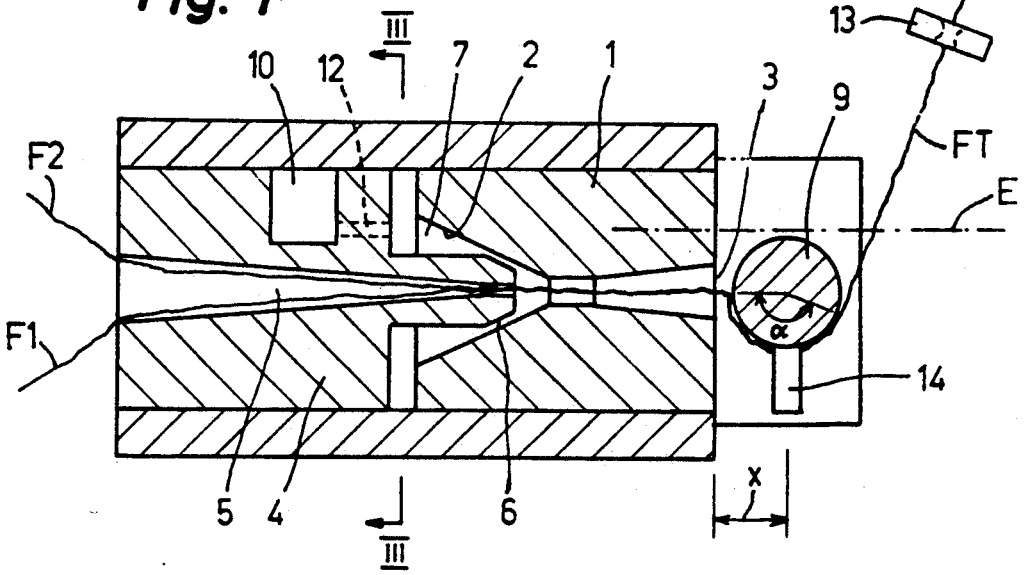
FIG. 1, parts of a device for jet-bulking diagrammatically in an axial section.
Figure 2:
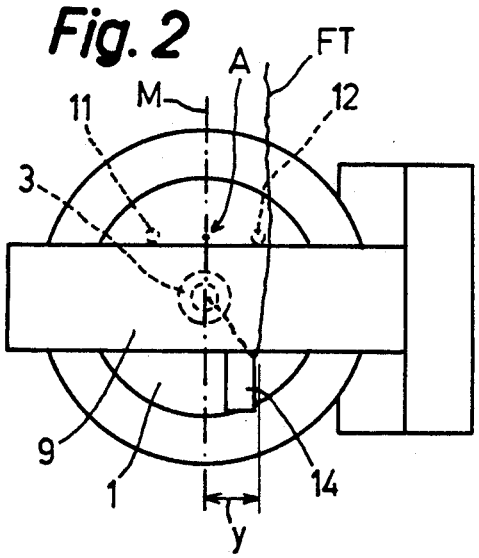
FIG. 2, a view from the right in FIG. 1.
Figure 3:
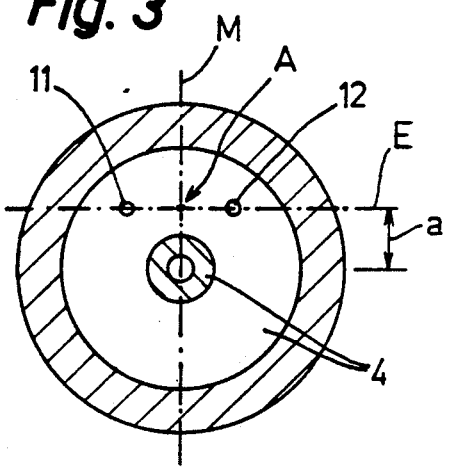
FIG. 3 a section along line III—III in FIG. 1.

The device for jet-bulking of at least one multifilament yarn, of which parts are diagrammatically represented in FIGS. 1 to 3, has, for example, a guide body 1, consisting of ceramic material, which contains a through bore with a conical inlet opening 2 and an outlet opening 3. Further, the device has a needle body 4, which contains a through yarn channel 5 coaxially aligned with the bore of guide body 1. Needle body 4 extends with one end into conical inlet section 2 of the bore of guide body 1 and exhibits on this end a conical peripheral surface, which, with the wall of conical inlet section 2 forms an annular passage gap 6 for a blowing medium, which can be introduced into annular space 7 surrounding needle body 4 in front of passage gap 6. On the outlet side of the bore of guide body 1 is placed an impact body 9, which, e.g., has the shape of a cylindrical pin.

A recess 10 running in a peripheral direction in needle body 4 is connected to a blowing medium connection (not shown), e.g., compressed air connection. The blowing medium is conducted preferably by two blowing medium feed bores 11 and 12 from recess 10 into annular space 7. Point A which is symmetrical to bores 11 and 12 in annular space 7 has a distance a of, for example, 3 to 10 mm, from the axis of the bore of guide body 1. Point A and the axis of the bore of guide body 1 determine a median plane M of the device.

Two multifilament yarns to be combined with one another and textured, namely a core yarn F1 and an effect yarn F2, are fed to yarn channel 5 of needle body 4. Core yarn F1 can be wetted, for example with water, immediately in front of the inlet into yarn channel 5 by an applicator (not shown). The multifilament yarns are blown in the bore of guide body 1 by the blowing medium jacket, which comes out from passage gap 6. Thus the yarns are intermingled with one another. The combined yarn is deflected on impact body 9. It runs around impact body 9 and then as textured yarn FT to a yarn guide 13. This yarn guide 13 is placed so that the yarn wraps around a peripheral area of impact body 9 extending over an obtuse angle $\alpha$ and then penetrates a plane E parallel to the axis of the bore of guide body 1, which goes through point A and is perpendicular to median plane M.

According to the invention the yarn, leaving outlet opening 3 of guide body 1, is deflected from median plane M. As a result, if multifilament yarns F1 and F2 are fed at speeds which are higher than the removal speed of textured yarn FT, a tension of textured yarn FT leaving impact body 9 is obtained, which is higher than in a yarn, which remains between outlet opening 3 and impact body 9 in the median plane. As a result, the entanglement level of the yarn is correspondingly higher. At the same time, also an even more intimate mixing of the individual filaments and more uniformly distributed loops bound more closely on the yarn core are achieved.

In the embodiment according to FIGS. 1 to 3 a yarn guide pin 14 is placed on impact body 9 for deflecting the yarn from median plane M.

At one place at a distance measured in the direction of the axis of the bore of guide body 1, from outlet opening 3 of x=4 to 12 mm, deflection y of the yarn from median plane M is at least 0.5 mm, preferably 2 to 8 mm.

EXAMPLE

A textured yarn was produced from a core yarn made from polyester dtex 167f72, which in front of the inlet into the texturing device was wetted by a water-conducting applicator, and an effect yarn made from polyester dtex 167f72x2. The speed of removal of the textured was 300 m/min. The feed speed of the core yarn was 336 m/min (excess delivery 12%). The feed speed of the effect yarn was 555 m/min (excess delivery 85%).

In a first test a texturing device, as represented in FIGS. 1 to 3, was used, with two air feed bores 1.41 mm in diameter on a partial circle with a radius of 8.3 mm. Impact body 9 and yarn guide pin 14 were dimensioned and placed so that at distance x=8 mm from outlet opening 3 yarn deflection y=4.5 mm. At a nozzle pressure of pe=10 bars, the yarn tensile force in the textured yarn leaving impact body 9 was 11.5 cN. The textured yarn had a compact structure with many small uniformly distributed loops.

In a second test, for comparison purposes a similar texturing device was used but with only one air feed bore and without the yarn guide pin (not according to the invention). At a nozzle pressure of pe=10 bars, the tensile force of the textured yarn leaving the impact body was 7.5 cN. The yarn had a rather closed structure, but with partially sizable, nonuniformly distributed loops. Thus in the comparison with this texturing device according to the prior art with the device according to the invention, an increase of the yarn tensile force by 50% and at the same time an improvement of the yarn uniformity were obtained, which can be put at about 25%.

Figure 4:
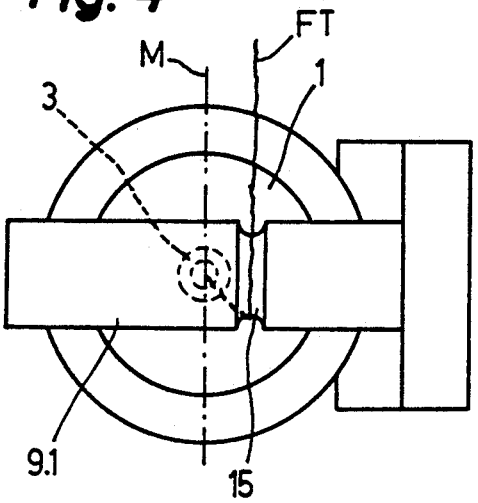
FIG. 4 and FIG. 5 in similar views as in FIG. 2 a variant each.

FIG. 4 shows in a view similar to FIG. 2 a modified embodiment of the invention, in which impact body 9.1, instead of yarn guide pin 14 of FIG. 2, exhibits a groove 15, which deflects the yarn coming from outlet opening 3 from median plane M.

Figure 5:
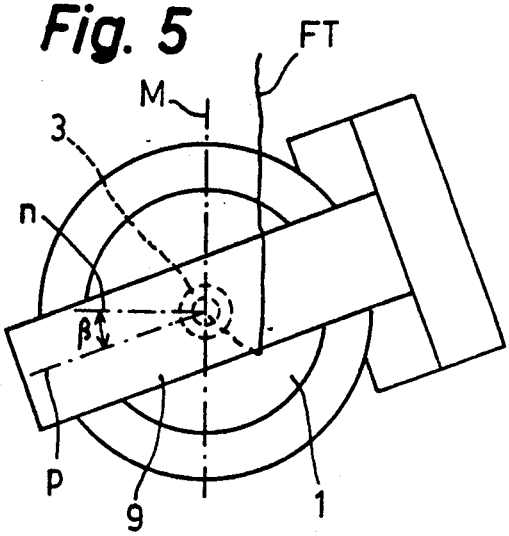

FIG. 5 shows another embodiment, in which impact body 9 again has the shape of a cylindrical pin. Yarn guide pin 14 is left out in this case, too. Instead, axis p of the impact body is placed sloping at an acute angle $\beta$ to a line n perpendicular to median plane M so that the cylindrical peripheral surface of impact body 9 deflects the yarn from median plane M. Angle $\beta$ can be approximately 2° to 30°.

Different measures for deflecting the yarn from median plane M, e.g., yarn guide pin according to FIG. 1, 2, groove according to FIG. 4, sloping position of the impact body according to FIG. 5 or also shifting of yarn guide 13 from the drawing plane of FIG. 1, could, of course, also be used in combinations.

For feeding the blowing medium in annular space 7, in front of passage gap 6 the two feed bores 11 and 12, circular in cross section, shown in FIGS. 1 to 3, are used, not only because of their simple shape but also because of the good effect that can be achieved with them.

But feed bores with any other cross section shapes or also only one feed bore or more than two feed bores are also possible. FIGS. 6 to 11 show in views similar to FIG. 3 the mouths of different usable feed bores. Point A of the mouth cross section or mouth cross sections in each case is also drawn in, and equally the median plane M going through this point A and the axis of the guide body bore, a plane from which the yarn coming from the guide body bore is deflected as described.

Figure 6:
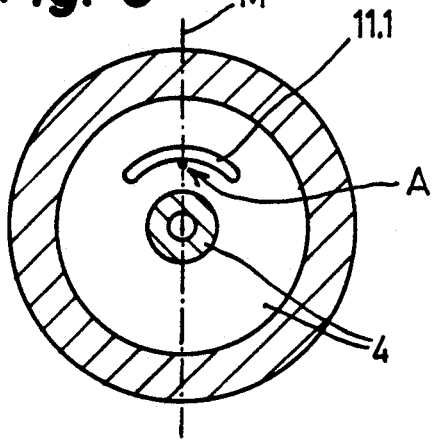
FIG. 6 to FIG. 11 in similar sectional views as in FIG. 3, another variant each.

FIG. 6 shows a feed bore 11.1 in the shape of a slot curved around the axis of the guide body bore. The slot could also be straight.

Figure 7:
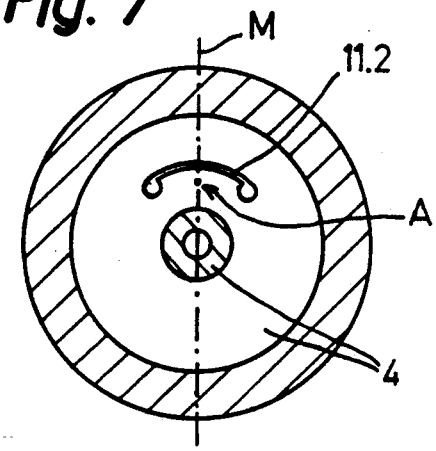

FIG. 7 shows a feed bore 11.2, which has the shape of a profiled slot. The cross section of this bore consists of two approximately circular segments, which are connected to one another by a narrow slot segment.

Figure 8:
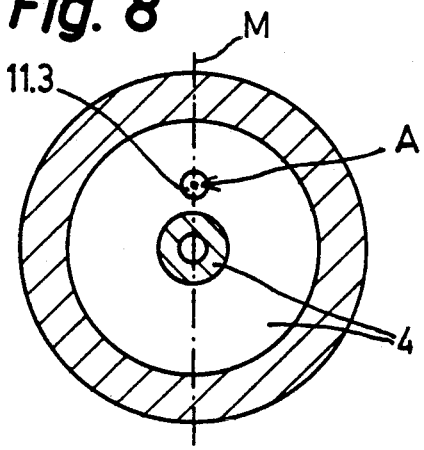

FIG. 8 shows a single feed bore 11.3 with circular cross section.

Figure 9:
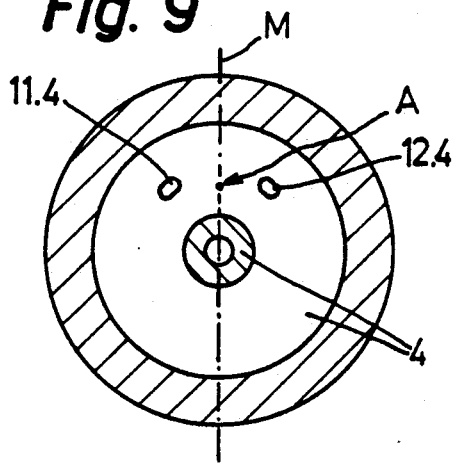

FIG. 9 shows, similar to FIG. 3, two feed bores 11.4 and 12.4, but which have oval cross-sectional shapes.

Figure 10:
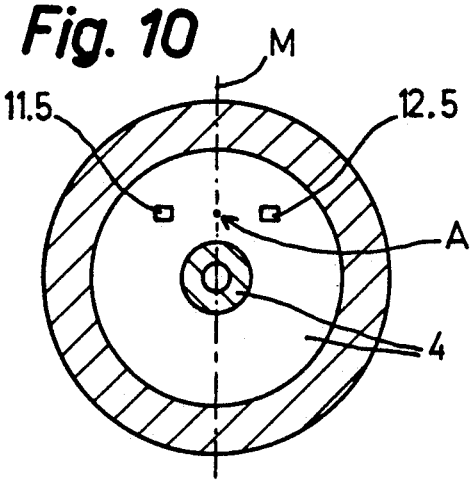

FIG. 10 shows two feed bores 11.5 and 12.5 with rectangular cross-sectional shapes.

Figure 11:
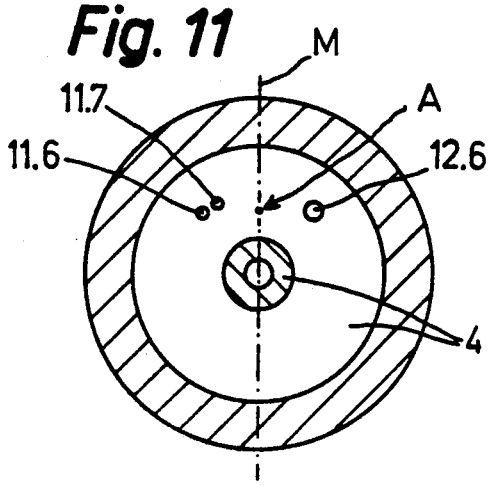

Finally, FIG. 11 shows three asymmetrically arranged feed bores 11.6, 11.7 and 12.6.

What is claimed is:

1. In a device for jet-bulking of at least one multifilament yarn, including a guide body (1), which exhibits a through bore with a conical inlet section (2) and an outlet opening (3), a needle body (4) which contains a through yarn channel (5) approximately coaxially aligned with the bore of said guide body (1), which needle body (4) extends with one end into said conical inlet section (2) and exhibits a peripheral surface which forms a passage gap (6) with the wall of said conical inlet section (2) for a blowing medium which can be introduced into an annular space (7) surrounding said needle body (4) in front of said passage gap (6), feed bore means (11, 12) for introducing said blowing medium into said annular space (7), said feed bore means (11, 12) emptying into said annular space (7) via a predetermined cross-sectional area, an impact body (9) placed on the outlet side of the bore of said guide body (1) to deflect yarn leaving said guide body (1), and a yarn guide means (13; 14; 15) that receives and guides yarn deflected by said impact body (9); the improvement wherein said yarn guide means (13; 14; 15) deflects said yarn from a median plane (M) which contains the axis of the guide body bore and is perpendicular to a plane (E) which is parallel to the axis of the guide body bore and located in such a way that said predetermined cross sectional area has portions of equal size on opposite sides of said parallel plane (E), said yarn guide means being displaced laterally from said median plane (M).

2. Device according to claim 1, wherein said impact body (9) and said yarn guide means (13) are placed so that a yarn leaving said outlet opening (3) of said guide body (1) wraps first around a peripheral area of said impact body (9) and continuing penetrates said parallel plane (E).

3. Device according to claim 1, wherein said yarn guide comprises a yarn guide pin (14) on said impact body (9) for deflecting the yarn from said median plane (M).

4. Device according to claim 1, wherein said impact body (9.1) exhibits a yarn guide groove (15) which comprises said yarn guide means and which deflects the yarn from said median plane (M).

5. Device according to claim 1, wherein said impact body (9) exhibits a cylindrical peripheral surface, whose axis (p) with a line (n) perpendicular to said median plane (M) forms an acute angle ($\beta$) of 2° to 30°.

6. Device according to claim 1, wherein when a distance (x) from said outlet opening (3) of said guide body (1) to the longitudinal axis of a yarn guide pin (14) is 4 to 12 mm, and the yarn is deflected from said median plane (M) by at least 0.5 mm.

7. Device according to claim 1, wherein said feed bore means comprises two blowing medium feed bores (11, 12) which empty into said annular space (7).

8. Device according to claim 1, wherein said feed bore means comprises a slot-shaped blowing medium feed bore (11.1, 11.2), which slot shaped blowing medium feed bore empties into said annular space (7).

9. Device according to claim 1, wherein the yarn is deflected from said median plane (M) by 2 to 8 mm.

10. Device according to claim 1, wherein said yarn guide means (13) is spaced downstream from said impact body in the direction of movement of said yarn.

* * * * *